US008766759B2

(12) United States Patent
Shih et al.

(10) Patent No.: US 8,766,759 B2
(45) Date of Patent: Jul. 1, 2014

(54) TRANSFORMER

(71) Applicant: Zippy Technology Corp., New Taipei (TW)

(72) Inventors: Tsun-Te Shih, New Taipei (TW); Yu-Yuan Chang, New Taipei (TW); Tzung-Han Lee, New Taipei (TW); Heng-Chia Chang, New Taipei (TW)

(73) Assignee: Zippy Technology Corp., New Taipei (TW)

( * ) Notice: Subject to any disclaimer, the term of this patent is extended or adjusted under 35 U.S.C. 154(b) by 0 days.

(21) Appl. No.: 13/632,368

(22) Filed: Oct. 1, 2012

(65) Prior Publication Data

US 2014/0091889 A1 Apr. 3, 2014

(51) Int. Cl.
*H01F 27/28* (2006.01)

(52) U.S. Cl.
USPC ..... 336/220; 336/184; 336/222

(58) Field of Classification Search
USPC ..... 336/212, 105, 220–223, 180–186
See application file for complete search history.

(56) References Cited

U.S. PATENT DOCUMENTS

| | | | | | |
|---|---|---|---|---|---|
| 4,536,733 | A * | 8/1985 | Shelly | 336/182 |
| 4,656,395 | A * | 4/1987 | Fahnrich et al. | 315/57 |
| 4,847,986 | A * | 7/1989 | Meinel | 29/606 |
| 5,055,816 | A * | 10/1991 | Altman et al. | 336/200 |
| 5,191,699 | A * | 3/1993 | Ganslmeier et al. | 29/602.1 |
| 8,193,895 | B2 * | 6/2012 | Wu et al. | 336/200 |
| 2009/0160596 | A1 * | 6/2009 | Yang et al. | 336/84 C |
| 2012/0212314 | A1 * | 8/2012 | Li et al. | 336/192 |

* cited by examiner

*Primary Examiner* — Alexander Talpalatski
*Assistant Examiner* — Mangtin Lian
(74) *Attorney, Agent, or Firm* — Muncy, Geissler, Olds & Lowe, P.C.

(57) ABSTRACT

A transformer comprises a circuit board, an iron core, a winding set and a plurality of magnetic conduction elements. The circuit board has a plurality of electric conduction holes connected via at least one power connection wire. The iron core is located on the circuit board and has a first winding section and a second winding section. The winding set is wound on the first winding section. Each magnetic conduction element has a connecting section located on the iron core and an input section and an output section inserted into the electric conduction holes. The output section of one magnetic conduction element is connected to the input section of another magnetic conduction element through the power connection wire, thereby the magnetic conduction elements and power connection wire form a magnetic conduction winding set which generates magnetic coupling with the winding set through the iron core.

7 Claims, 3 Drawing Sheets

TRANSFORMER

FIELD OF THE INVENTION

The present invention relates to a transformer and particularly to a transformer that has a primary coil and a secondary coil formed a conductive element and arranged in parallel to generate high leakage inductance.

BACKGROUND OF THE INVENTION

Transformers are made in a wide variety of forms to meet different requirements. Design of a transformer has to consider many performance parameters, such as transforming ratio, voltage gain, magnetic leakage coefficient, loss and the like. The transformer mostly seen at present mainly includes a primary winding set, an iron core and a secondary winding set to generate magnetic coupling with the primary winding set through the iron core. In order to reduce leakage inductance of the transformer when in use, the primary winding set and the secondary winding set usually are overlapped with each other. More specifically, first, the primary winding set is wound on the iron core, then the secondary winding set is wound overlapping the primary winding set. Such an arrangement can make the secondary winding set generate as much magnetic coupling with the primary winding set as possible, thereby the leakage inductance when the transformer is in use can be reduced and the problem of electromagnetic interference (EMI) also can be decreased.

However, the requirements for the transformer at present not always demand low leakage inductance. For instance, the transformer for igniting a cold cathode fluorescent tube or an LLC resonant transformer with the leakage inductance serving as the resonant inductance requires greater leakage inductance to realize required electrical characteristics. But the aforesaid commonly adopted conventional transformers with overlapped primary winding set and secondary winding set cannot get greater leakage inductance. In addition, the conventional transformer, aside from the iron core, primary winding set and secondary winding set, often includes a coil rack for winding the primary winding set and secondary winding set, with the iron core held in the coil rack to finish assembly of the transformer. The transformer equipped with the coil rack is bulky and makes microminiaturization of the transformer difficult. Moreover, when in use power transformation also generates loss, such as copper loss, vortex loss or the like. The loss often creates waste heat. The present transformer structure does not provide heat dissipation function. With the primary winding set and secondary winding set overlapped with each other, only the primary winding set or secondary winding set at the outmost side can perform heat exchange with the external air to disperse a portion of heat. The remaining waste heat is accumulated in the primary winding set, secondary winding set or iron core, which creates undesirable effect on the transformer.

SUMMARY OF THE INVENTION

The primary object of the present invention is to overcome the problem of the conventional transformers that cannot provide higher leakage inductance.

Another object of the invention is to solve another problem of the conventional transformers whose size is difficult to be shrunk because of the coil rack.

Yet another object of the invention is to resolve another problem of the conventional transformers of not providing effective heat dissipation and resulting in accumulation of waste heat inside.

To achieve the foregoing objects, the present invention provides a transformer that comprises a circuit board, an iron core, a winding set and a plurality of magnetic conduction elements. The circuit board has an installation zone, a plurality of electric conduction holes formed on the installation zone and at least one power connection wire bridging any two of the electric conduction holes to form electric conduction. The iron core is located on the circuit board, and has a first winding section and a second winding section located on the installation zone. The winding set has a plurality of coils wound on the first winding section. Each magnetic conduction element has a connecting section located on the second winding section and an input section and an output section connecting to the connecting section and inserting into the electric conduction holes. The input section of one magnetic conduction element is connected to the output section of another magnetic conduction element through the power connection wire so that the magnetic conduction elements and the power connection wire form a magnetic conduction winding set. The magnetic conduction winding set and the winding set form magnetic coupling through the iron core.

In one embodiment the circuit board includes a power rectification circuit connecting to the magnetic conduction winding set to get electric power for rectification.

In another embodiment the circuit board includes a power filter circuit connecting to the magnetic conduction winding set to get electric power for filtering.

In yet another embodiment the magnetic conduction element is a magnetic conduction copper plate.

In yet another embodiment the circuit board includes a holding portion adjacent to the installation zone to hold the winding set, and the holding portion can be a notch on the circuit board.

In yet another embodiment the circuit board has a positioning portion to hold the iron core.

Through the structure set forth above, compared with the conventional transformers, the invention provides features as follow:

1. The transformer thus formed has greater leakage inductance. With the winding set and magnetic conduction winding set wound respectively on the first and second winding sections of the iron core, the non-magnetic coupling portion between the winding set and magnetic conduction winding set increases, hence greater leakage inductance is generated. Moreover, the magnetic conduction winding set is composed of the magnetic conduction elements and power connection wire, and the magnetic conduction elements are arranged in a density lower than that of the wound coils and also have a smaller portion magnetically coupled with the winding set, thereby greater leakage inductance can be generated.

2. The transformer can be made smaller. The transformer of the invention does not have a coil rack to hold the winding set and magnetic conduction winding set, but allows the iron core to be directly mounted onto the circuit board, and then lets the winding set and magnetic conduction winding set be wound on the iron core, hence can save the space for holding the coil rack that is required in the conventional transformer.

3. Improved cooling effect is provided. On the transformer of the invention the winding set and magnetic conduction winding set are wound respectively on the first and second winding sections, hence can prevent waste heat caused by copper loss from accumulating on the winding set and magnetic conduction winding set.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
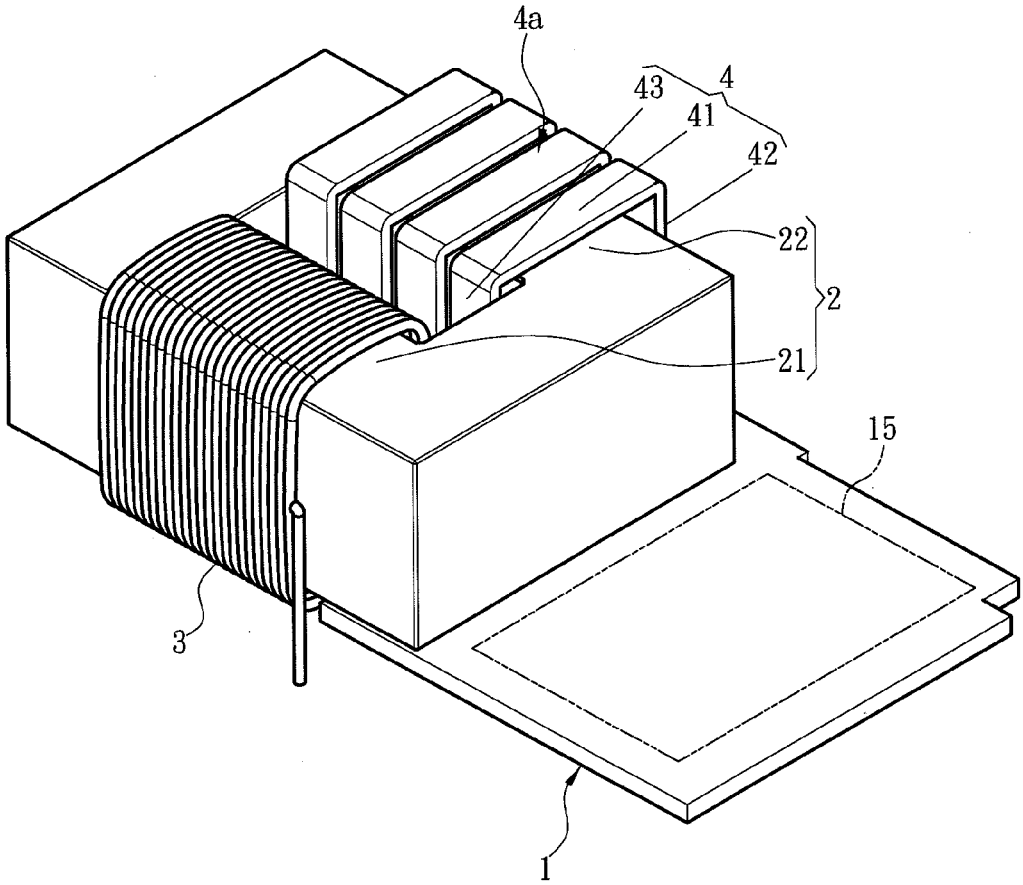
FIG. 1 is a perspective view of an embodiment of the invention.
Figure 2:
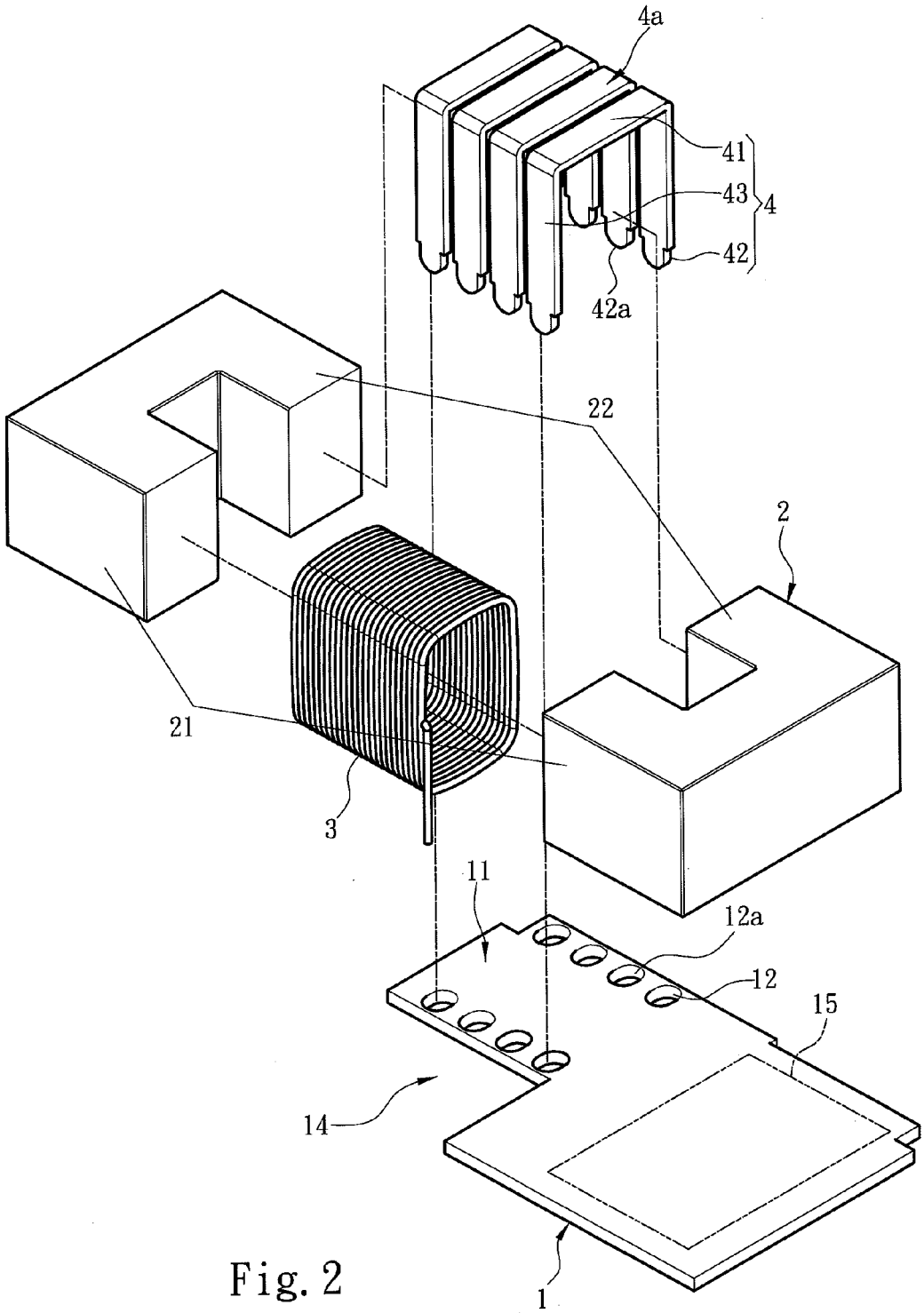
FIG. 2 is an exploded view of an embodiment of the invention.
Figure 3:
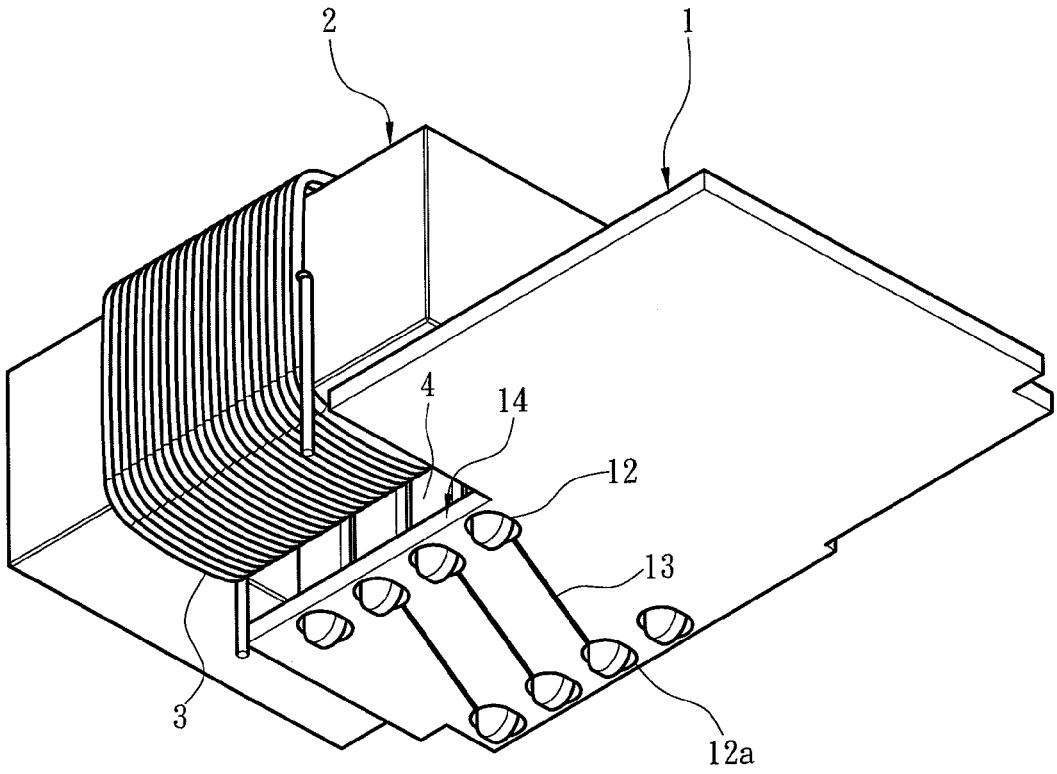
FIG. 3 is another perspective view of an embodiment of the invention.

Please refer to FIGS. 1, 2 and 3 for an embodiment of the transformer of the invention. The transformer comprises a circuit board 1, an iron core 2, a winding set 3 and a plurality of magnetic conduction elements 4. The circuit board 1 can be a bridge board located in an electronic device to bridge other circuits, or a motherboard in the electronic device to carry other electronic elements therein. The circuit board 1 can be implemented in a wide variety of types, thus details are omitted herein. The circuit board 1 has an installation zone 11, a plurality of electric conduction holes 12 formed on the installation zone 11 and at least one power connection wire 13 laid on the installation zone 11. The installation zone 11 means a location on the circuit board 1 where the transformer is installed. The electric conduction holes 12 are arranged orderly on the installation zone 11, and can be arranged in a matrix as shown in FIG. 2. The number of the electric conduction holes 12 can be adjusted depending on the number of the magnetic conduction elements 4. The power connection wire 13 can be laid on another surface of the circuit board 1 to bridge any two of the electric conduction holes 12 to form electric connection between them. Refer to FIG. 3, one electric conduction hole 13 is connected to another electric conduction hole 12*a*. When multiple power connection wires 13 are provided, they also can be connected in a similar way as previously discussed, thus details are omitted.

The iron core 2 is located on the circuit board 1, and has a first winding section 21 and a second winding section 22. The second winding section 22 is located on the installation zone 11 after the iron core 2 has been installed on the circuit board 1. More specifically, the second winding section 22 can be positioned between any two of the electric conduction holes 12, with the electric conduction holes 12 at two sides of the second winding section 22. The iron core 2 can be formed in various types, such as composed of multiple magnetic cores or formed in a single magnetic core. FIG. 2 illustrates one embodiment with multiple magnetic cores as an example. After the multiple magnetic cores are composed to form the iron core 2, the first winding section 21 and second winding section 22 are formed at the junctions thereof. The winding set 3 is formed by winding a conductive wire in multiple coils on the first winding section 21. The first winding section 21, aside from connecting to the circuit of the circuit board 1, further can be connected to an external power source or another circuit board (not shown in the drawings). In addition, the circuit board 1 has a holding portion 14 adjacent to the installation zone 11 to hold the winding set 3. The holding portion 14 can be a notch formed on the circuit board 1, as shown in FIG. 2. On the other hand, the circuit board 1 can also include a positioning portion to hold the iron core 2. The positioning portion can be a retaining structure on the circuit board 1, or a retaining structure formed by resin solidified on the circuit board 1.

Please also referring to FIGS. 1 and 2, each magnetic conduction element 4 has a connecting section 41 and an input section 42 and an output section 43 connecting to the connecting section 41. The magnetic conduction element 4 can be formed in an inverse U shape as shown in FIG. 2. During installation of the magnetic conduction element 4, the connecting section 41 is located on the second winding section 22, and the input section 42 and output section 43 are positioned at two sides of the iron core 2 and inserted into the electric conduction holes 12. The output section 43 of one magnetic conduction element 4 is connected to the input section 42*a* of another magnetic conduction element 4*a* via the power connection wire 13 to form a magnetic conduction winding set. The magnetic conduction winding set and the winding set 3 form magnetic coupling through the iron core 2. The magnetic conduction element 4 can be a magnetic conduction copper plate.

As previously discussed, the winding set 3 and magnetic conduction winding set provided in the invention can serve as the primary coil and secondary coil of the transformer. The winding set 3 receives external electric power, and generates inductance with the magnetic conduction winding set through the iron core 2, thereby generate electric power conversion, finally output through the magnetic conduction winding set. Moreover, the circuit board 1 can include a power rectification circuit 15 or a power filter circuit (not shown in the drawings) to connect to the magnetic conduction winding set. The power rectification circuit 15 or the power filter circuit receives the electric power from the magnetic conduction winding set to perform rectification or filtering. The rear end of the power rectification circuit 15 or the power filter circuit can also connect to another circuit to output the rectified or filtered power for utilizing as desired. The embodiments previously discussed merely serve for illustrative purpose, and are not the limitations of the invention.

In short, the transformer of the invention has the winding set and the magnetic conduction winding set formed via magnetic conduction elements located respectively on the first winding section and second winding section of the iron core without overlapping with each other. Hence transformer has greater leakage inductance. Moreover, the iron core is directly mounted onto the circuit board without using a coil rack as the conventional transformer does, thus the transformer can be made smaller. In addition, the magnetic conduction elements also provide improved heat dissipation and can prevent extra amount of heat from accumulating in the transformer.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A transformer, comprising:

a circuit board including an installation zone, a plurality of electric conduction holes formed on the installation zone and at least one power connection wire bridging any two of the plurality of electric conduction holes to form electric conduction;

an iron core which is located on the circuit board and includes a first winding section and a second winding section located on the installation zone;

a winding set being formed by winding a conductive wire in multiple turns on the first winding section of the iron core; and a plurality of magnetic conduction elements each including a connecting section located on the second winding section and an input section and an output section connecting to the connecting section and inserting into the electric conduction holes;

wherein the output section of one magnetic conduction element is connected to the input section of another magnetic conduction element via the power connection wire such that the magnetic conduction elements and the power connection wire form a single magnetic conduction winding set which generates magnetic coupling with the winding set through the iron core, and wherein the magnetic conduction elements are arranged in a density lower than that of the multiple turns formed by the conductive wire of the winding set.

2. The transformer of claim 1, wherein the circuit board includes a power rectification circuit connecting to the magnetic conduction winding set to get electric power for rectification.

3. The transformer of claim 1, wherein the plurality of magnetic conduction elements are respectively a magnetic conduction copper plate.

4. The transformer of claim 1, wherein the circuit board includes a holding portion adjacent to the installation zone to hold the winding set.

5. The transformer of claim 4, wherein the holding portion is a notch on the circuit board.

6. The transformer of claim 1, wherein the iron core has two legs joined to opposite ends of at least one end portion, the first and second winding sections being part of the first and second legs, respectively, so that the first and second winding sections are separated from each other.

7. The transformer of claim 1, wherein a length of the winding set on the iron core is the same as a length of the magnetic conduction winding set on the iron core.

* * * * *